US007138214B2

(12) United States Patent
Mikuriya et al.

(10) Patent No.: US 7,138,214 B2
(45) Date of Patent: Nov. 21, 2006

(54) POSITIVELY CHARGEABLE TONER

(75) Inventors: Yoshihiro Mikuriya, Nishinomiya (JP); Masahiro Anno, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 239 days.

(21) Appl. No.: 10/790,734

(22) Filed: Mar. 3, 2004

(65) Prior Publication Data

US 2005/0064312 A1 Mar. 24, 2005

(30) Foreign Application Priority Data

Sep. 22, 2003 (JP) ..... 2003-329674

(51) Int. Cl.
*G03G 9/087* (2006.01)

(52) U.S. Cl. ..... 430/109.1; 430/109.31

(58) Field of Classification Search ..... 430/109.1, 430/109.31, 137.11, 137.14
See application file for complete search history.

(56) References Cited

U.S. PATENT DOCUMENTS 5,532,097 A 7/1996 Tavernier et al.
5,763,130 A * 6/1998 Sasaki et al. ..... 430/110.2
5,789,131 A * 8/1998 Mikuriya et al. ..... 430/108.24
6,037,090 A * 3/2000 Tanaka et al. ..... 430/109.4

FOREIGN PATENT DOCUMENTS

| | | |
|---|---|---|
| JP | 63-158566 | 7/1988 |
| JP | 05-119524 | 5/1993 |
| JP | 07-160038 | 6/1995 |
| JP | 08-054755 | 2/1996 |
| JP | 10-110039 | 4/1998 |
| JP | 10-333358 | 12/1998 |
| JP | 2002-229253 | 8/2002 |
| JP | 2003-091101 | 3/2003 |

* cited by examiner

*Primary Examiner*—John L Goodrow
(74) *Attorney, Agent, or Firm*—Buchanan Ingersoll & Rooney PC

(57) ABSTRACT

A positively chargeable toner, comprising:

toner particles that are formed by allowing resin particles containing an amino-group and colorant particles to aggregate, the toner having an amine value in a range of 5 to 35 KOHmg/g, being excellent in fixing properties, heat resistant storing property and chargeability.

14 Claims, No Drawings

POSITIVELY CHARGEABLE TONER

This application is based on application Ser. No. 2003-329674 filed in Japan, the contents of which are hereby incorporated by reference.

BACKGROUND OF THE INVENTION

1. Field of the Invention

The present invention relates to a positively chargeable toner that is used for an electrophotographic method.

2. Description of the Related Art

With respect to the positively chargeable toner, a pulverized toner, which is obtained by subjecting, for example, a binder resin such as a styrene-acrylic-based resin, a nigrosine dye, a positive-charge controlling agent such as a quaternary ammonium salt or triphenyl methane and a wax for preventing offset to fusing/kneading/pulverizing processes, has been conventionally known. In order to impart sufficient positive chargeability to the toner of this type, a positive charge controlling agent is normally added thereto at a rate of about 3 to 7 parts by weight with respect to 100 parts by weight of the binder resin. However, in the case when the positively chargeable toner of this type is applied to a two-component developer that is used together with magnetic carrier, spent positive charge controlling agent is generated on the surface of the magnetic carrier within repetitive use for a long time, resulting in degradation in the frictional charging function (toner chargeability) of the carrier to the toner and the subsequent toner fogging on a non-image portion of an image. The nigrosine dye is often used as the charge controlling agent; however, such a dye-based charge controlling agent has a blackish color, and is not suitable for color developing processes.

In order to solve the above-mentioned problem, in the pulverizing method, a technique in which, in place of the positive charge controlling agent, for example, a positive charge controlling resin is added has been proposed (for example, see Unexamined Japanese Patent Publication No. 10-333358). However, since the toner is manufactured through a pulverizing method and since the added amount of the wax is subsequently limited, it is not possible to sufficiently prevent offset, resulting in problems in the toner fixing property. When the added amount of wax is increased so as to improve the fixing property, the wax tends to be exposed to the toner surface, resulting in problems with the toner chargeability.

In this manner, the disadvantage of the positive chargeable pulverized toner is that it is difficult to make the fixing property and the charging property well balanced with each other, and this forms a major problem with the pulverized-type toner.

In recent years, there have been strong demands for an oil-less system and an energy-conserving apparatus in the fixing system, and there have been many proposals in which these functions are imparted to wet-type polymerization toners. The wet-type polymerization toner refers to a toner manufactured through a wet-type polymerization method such as a so-called emulsion polymerization method and suspension polymerization method, and with respect to the toner of this type, more wax can be added to the toner to a certain extent in comparison with the pulverized toner, without causing adverse effects on the chargeability.

At present, among these demands, in an attempt to achieve an energy-conservation fixing process, many companies are vigorously trying to design low-temperature fixing systems, and many related novel techniques have been proposed; however, these techniques have the following disadvantages.

In an attempt to achieve toner low-temperature fixing processes, there are mainly two approaches. That is, one is to provide a resin with lower viscosity, and the other is to lower the melting point of the wax to further increase the added amount. However, the common problem with these methods is to cause a great reduction in the viscosity of the toner. Subsequently, problems such as a reduction in the resin viscosity, degradation in the heat resistant storing property and the anti-blocking property due to a viscosity reduction in the resin and a lowered melting point of the wax, and deterioration in the charging property and cleaning property due to an increased amount of wax, have been raised.

These problems can be solved to a certain extent by modifying the toner structure into a capsule structure and a core-shell structure. For example, in a styrene-acrylic copolymer composition that can be manufactured by an emulsion polymerization method, the molecular weight of the inner layer is made smaller, while the molecular weight of the outer layer is made greater, so that the viscosity of the toner outer shell layer is improved, thereby making it possible to improve the heat resistant storing property and the anti-blocking property of the toner. However, even when such a toner structure is used, this solution is still dependent on the toner viscosity and the resin is designed based upon the balance between the viscous component and the elastic component; therefore, in the case when the designing is carried out with a view to improving the low-temperature fixing property, the elastic function is lowered and the fixing separation property and the anti-offsetting property at the time of an oil-less fixing process are seriously lowered.

Even in an attempt to carry out the controlling process based upon the melting-point and added amount of the wax without adjusting the visco-elastic function of the resin, since the visco-elastic function of the toner is changed in the same manner as the resin, problems arise with respect to the visco-elastic function controls of the resin.

Therefore, at present, in order to achieve a low-temperature fixing process, the conventional toners need to sacrifice the other properties (such as fixing separation property and anti-offset property) of the fixing properties.

SUMMARY OF THE INVENTION

The objective of the present invention is to provide a positively chargeable toner that is superior in fixing properties, such as a low-temperature fixing property, a fixing separation property and an anti-offset property, as well as in heat resistant storing property and chargeability.

The present invention provides a positively chargeable toner, comprising toner particles that are formed by allowing resin particles and colorant particles to aggregate, and the toner has an amine value in a range of 5 to 35 KOHmg/g.

DETAILED DESCRIPTION OF THE INVENTION

The present invention relates to a positively chargeable toner, comprising:

toner particles that are formed by allowing resin particles containing an amino-group and colorant particles to aggregate, the toner having an amine value in a range of 5 to 35 KOHmg/g.

The positively chargeable toner of the present invention makes it possible to achieve superior low-temperature fixing property and superior fixing separation property as well as anti-offset property, and also to simultaneously achieve superior fixing properties, such as low-temperature fixing property, fixing separation property and anti-offset property, and superior chargeability. It is also possible to provide a superior heat resistant storing property. In particular, the positively chargeable toner of the present invention exerts superior fixing strength even when the fixing temperature is set to a comparatively low temperature, for example, in a range from 120 to 130° C.

The positively chargeable toner of the present invention contains toner particles that are formed by allowing at least resin particles and colorant particles to aggregate/fuse to one another in an aqueous medium.

In the present specification, the term "aggregation" is used as the concept that at least a plurality of resin particles are simply allowed to adhere to one another. Although constituent particles are made in contact with one another through "aggregation", bonds, which are made through fusion between the resin particles, are not formed; thus, so-called hetero-aggregated particles (group) are formed. The particle group, formed through such "aggregation", is referred to as "aggregated particles".

The term "fusion" is used as the concept that a bond is formed through melting between resin particles at least one portion on the interface of the respective constituent particles in the aggregated particles to provide one particle that forms a unit in use and handling. The group of particles that are subjected to such "fusion" are referred to as "fused particles".

The term "aggregating/fusing" indicates that aggregating and fusing processes are carried out simultaneously or step by step, or the action that allows the aggregating and fusing processes to take place simultaneously or step by step.

In the present invention, resin particles are allowed to contain an amino-group-containing monomer as its constituent monomer so that the toner is allowed to have a predetermined amine value, thereby making it possible to achieve superior low-temperature fixing property and superior fixing separation property as well as anti-offset property, while maintaining proper positive chargeability. In other words, in the present invention, without the necessity of reducing the viscosity of the resin beyond the necessary level, lowering the melting point of the wax, or increasing the content of the wax beyond the necessary level so as to greatly change the toner visco-elasticity, the resin particles are allowed to contain an amino-group-containing monomer as its constituent monomer so as to achieve a predetermined amine value so that it becomes possible to improve the low-temperature fixing property, and consequently to ensure a superior fixing separation property and an anti-offset property, even in the case of an oil-less fixing process. It is also possible to ensure proper positive chargeability. Although it has not been clearly clarified how the addition of the amino-group-containing monomer and the toner having a predetermined amine value can improve the low-temperature fixing property, it is considered that a hydrogen bond is formed between the toner and a recording medium (paper), in particular, between the amino group derived from the amino-group-containing monomer in the toner and a hydroxide group on the paper surface, to improve its affinity. By setting the amine value within a predetermined range, it becomes possible to improve the affinity between the binder resin as well as the colorant and the wax, and consequently to improve the dispersing property of the colorant and the wax in the toner particles. For this reason, it is possible to effectively improve the fixing properties such as the low-temperature fixing property, fixing separation property and anti-offset property while suppressing influences of the toner given to the chargeability and heat resistant storing property of the toner, and consequently to achieve both of superior fixing properties and superior chargeability, while maintaining proper positive chargeability. It becomes possible to effectively increase the image density. Since the anti-hygroscopic property is hardly lowered even when the amino-group-containing monomer is contained, it becomes possible to provide good images stably without being affected by environmental fluctuations. The application of a monomer containing a carboxyl group can be proposed in place of the amino-group-containing monomer in an attempt to improve the affinity between the toner and paper; however, even when the carboxyl-group-containing monomer is contained, the low-temperature fixing property is not improved so effectively, and in contrast, the anti-hygroscopic property of the toner deteriorate, resulting in fogging, in particular, in a high-humidity environment.

The amine value of the toner of the present invention is from 5 to 35 KOHmg/g, preferably from 5.5 to 35 KOHmg/g, more preferably from 6 to 28 KOHmg/g. When the amine value is too small, the improving effects for the affinity between the toner and paper become too small, failing to effectively improve the low-temperature fixing property. It is not possible to maintain superior chargeability as the positively chargeable toner. When the amine value is too big, the charging level tends to have a rise, causing instability in the charging level and the subsequent fogging. The heat resistant storing property and anti-hygroscopic property tend to deteriorate. Since the aggregating property in the resin particles becomes unstable, it becomes difficult to provide a sharp particle size distribution.

In the present specification, the amine value is obtained as a value measured by the following method. In other words, about 1 g of a sample was weighed, and to this was added 20 ml of toluene and dissolved therein, and were further added 20 ml of isopropyl alcohol and several drops of Bromophenol Blue; then, this solution was titrated by adding a 1/10 N isopropyl alcohol hydrochloride solution, and titer values were read up to the final point. Based upon the titer values, the amine value was calculated based upon the following formula. In the following formula, f represents a factor (potency) of a 1/10 N isopropyl alcohol hydrochloride solution.

$$\text{Amine value} = \frac{\text{Titer (ml)} \times f \times 5.61}{\text{Weighed amount (g) of sample}}$$

In the present invention, the acid value of the toner is set in a range from 0.1 to 30 KOHmg/g, preferably from 0.1 to 20 KOHmg/g, more preferably from 0.1 to 10 KOHmg/g; thus, it becomes possible to further improve the dispersing property of the colorant and wax in the toner particles. Thus, the fixing properties are improved more effectively, and the image density is also increased more effectively.

In the present invention, the total amount of nitrogen in the toner is from 0.5 to 3.0%, preferably from 0.6 to 2.5%.

The total amount of nitrogen corresponds to a weight rate of the total nitrogen atoms existing in the toner with respect to the total amount of the toner. The total amount of nitrogen can be measured as follows: the toner is heated to a high temperature in an oxygen atmosphere to be thermally decomposed into NOXs (nitrogen oxides in a gaseous state), and then measured by a trace carbon analyzer (TN-10: made by Mitsubishi Chemical Corporation). The total amount of nitrogen needs not be measured by the above-mentioned device. Any device may be used as long as it can measure the total amount of nitrogen based upon the same principle and rules as the above-mentioned device.

The resin particles forming the toner particles of the present invention are made from a polymer resin composed of an amino-group-containing monomer and another polymerizable monomer.

The amino-group-containing monomer is a monomer that contains an amino group and is also radical-polymerizable, and examples thereof include acrylates, methacrylates, styrenes, allyls, vinyls and dienes that contain an amino group. In the present invention, with respect to the amino group, examples thereof include: a substituted amino group in which an unsubstituted amino group or one or two hydrogen atoms of the amino group are respectively substituted by other substituents, such as a methyl group, an ethyl group, a butyl group, a cyclohexyl group, a phenyl group and a benzyl group, or a cyclic amino group. With respect to the cyclic amino group, examples thereof include: a pyridyl group, a quinolyl group, a carbazolyl group, a pyrrolyl group, an imidazolyl group, a pyrazolyl group, a piperidyl group, a pyrrolidone-ring-containing group and a lactam-ring-containing group.

Specific examples of such amino-group-containing monomers include: substituted-amino-group containing acrylates, such as N-methylaminoethyl acrylate, N-ethylaminoethyl acrylate, N,N-dimethylaminoethyl acrylate, N,N-diethylaminoethyl acrylate, N,N-dibutylaminoethyl acrylate and N,N-diethylaminopropyl acrylate; substituted-amino-group containing methacrylates, such as aminoethyl methactylate, N,N-dimethylaminoethyl methacrylate, N,N-diethylaminoethyl methacrylate, N-methylaminoethyl methacrylate, N-ethylaminoethyl methacrylate, 2-N,N-dicyclohexylaminoethyl methacrylate, N,N-dibutylaminoethyl methacrylate, 2-phenylaminoethyl methacrylate and 2-benzylaminoethyl methacrylate; aminostyrenes, such as aminostyrene, dimethylaminoethyl styrene, N-methylaminoethyl styrene and dimethylaminoethoxy styrene; allyl amines, such as allyl amine and allylmethyl amine; vinyl pyridines, such as 2-vinyl pyridine, 3-vinyl pyridine, 4-vinyl pyridine, 2-methyl-5-vinyl pyridine, 2-methyl-6-vinyl pyridine, 5-ethyl-2-methylpyridine and 2,6-dimethyl-5-vinyl pyridine; vinyl piperidines such as 2-vinyl piperidine; vinyl pyrroles such as 2-vinyl pyrrole; vinyl quinolines such as 4-vinyl quinoline; other vinyl carbazoles, vinyl imidazoles, vinyl pyrazolines, allyl quinolines, vinyl amines, vinyl pyrrolidones such as N-vinyl pyrrolidone, and vinyl lactams such as N-vinyl lactam and N-vinyl caprolactam. Among these, substituted-amino-group containing acrylates and substituted-amino-group containing methacrylates are preferably used.

The content of the amino-group containing monomer is not particularly limited as long as the resulting toner has a predetermined amine value; and it is normally set from 4 to 30% by weight, preferably from 5 to 30% by weight, more preferably from 5 to 20% by weight, with respect to the entire monomer components constituting resin particles.

With respect to another polymerizable monomer (hereinafter, referred to simply as polymerizable monomer), not particularly limited as long as it is a monomer capable of forming an addition polymerization-type resin to be used for a toner-use binder resin, and examples thereof include: styrenes, such as styrene, o-methylstyrene, m-methylstyrene, p-methylstyrene, α-methylstyrene, p-chlorostyrene, 3,4-dichlorostyrene, p-n-butylstyrene, p-tert-butylstyrene, p-nonylstyrene and p-phenylstyrene; acrylate acid esters, such as methyl acrylate, ethyl acrylate, propyl acrylate, n-butyl acrylate, isobutyl acrylate, hydroxyethyl acrylate, and 2-ethylhexyl acrylate; methacrylic acid esters, such as methyl methacrylate, ethyl methacrylate, propyl methacrylate, n-butyl methacrylate, isobutyl methacrylate, hydroxyethyl methacrylate and 2-ethylhexyl methacrylate; cyclohexene, acrylonitrile, methacrylonitrile, vinyl chloride and vinyl acetate.

With respect to the polymerizable monomer, an acid monomer having an acidic polar group may be used. With respect to the acidic monomer, examples thereof include monomers of acids having a carboxyl group, such as acrylic acid, methacrylic acid, maleic acid, maleic anhydride, fumaric acid and cinnamic acid, and monomers having a sulfonic acid group such as sulfonated styrene.

In the present invention, with respect to the polymerizable monomer, substituted-amino-group containing acrylates (and/or substituted-amino-group containing methacrylates), styrene and acrylic acid esters (and/or methacrylic acid esters) are preferably used, and with respect to acidic monomers, acrylic acid and methacrylic acid are preferably used.

With respect to the polymerizable monomer, a crosslinking-type monomer may be used. With respect to the crosslinking-type monomer, examples thereof include: compounds having two or more unsaturated bonds, such as divinyl benzene, divinyl naphthalene, divinyl ether, diethylene glycol dimethacrylate, ethylene glycol dimethacrylate, 1,6-hexane diol diacrylate, polyethylene glycol dimethacrylate, diallyl phthalate, butadiene and isoprene.

The weight-average molecular weight (Mw) of polymer forming resin particles is normally from 15,000 to 500,000, preferably from 20,000 to 200,000, more preferably from 25,000 to 150,000. The softening point is normally from 90 to 140° C., preferably from 100 to 130° C., more preferably from 110 to 120° C.

In the present invention, the resin particles may have any structure, and, for example, a single structure formed through one stage of polymerization process may be used, or a composite structure, formed by multiple layers of resins through multi-stages of polymerization, may be used. In the present invention, from the viewpoints of proper manufacturing properties and degree of freedom in designing the molecular weight of a latex to be obtained, each resin particle is preferably formed to have a three-layered structure in which on a center portion, an intermediate layer and an outer layer are successively laminated. In the case when the resin particle has a composite structure having multiple layers, the content of the amino-group containing monomer and the weight-average molecular weight with respect to the entire particles are respectively set in the above-mentioned ranges.

When the resin particles have a composite structure, the amino-group containing monomer may be contained in any of the layers as long as the amine value of the toner is set in the above-mentioned range, and from the viewpoint of suppressing an increase in the toner charge, it is preferable to avoid the structure in which the amino-group containing monomer is contained in the outermost layer forming the particle surface.

In particular, in the case when the resin particle has a three-layered structure in which on a center portion, an intermediate layer and an outer layer are successively laminated, from the viewpoint of improving the lower-temperature fixing property, the amino-group-containing monomer is preferably contained in at least the resin forming the intermediate layer as a constituent monomer, and more preferably contained in the resin forming the intermediate layer as well as in the resin forming the center portion. In the case when the amino-group-containing monomer is contained in the intermediate layer as well as in the resin forming the center portion, from the viewpoint of improving the low-temperature fixing property, the rates of content of the amino-group-containing monomer in the intermediate layer and the center portion are preferably set in a range from 2 to 38% by weight with respect to the entire constituent monomers in the respective layers. The rate of content of the amino-group-containing monomer in the intermediate layer, which is a weight rate of the amino-group-containing monomer with respect to the entire constituent monomers of the resin forming the intermediate layer, is more preferably set in a range from 4 to 36% by weight, most preferably from 10 to 30% by weight. The rate of content of the amino-group-containing monomer in the center portion, which is a weight rate of the amino-group-containing monomer with respect to the entire constituent monomers of the center portion, is preferably set in a range from 4 to 36% by weight, more preferably from 10 to 30% by weight.

In the case when the resin particle has a composite structure, from the viewpoints of easiness in forming the resin particles and aggregating property of the resin particles with colorant particles, in particular, carbon black, the above-mentioned acid monomer is preferably contained in the outermost layer forming the particle surface as a constituent monomer. Although not particularly limited as long as the acid value of the toner is set within the above-mentioned range, the content of the acid monomer in the outermost layer is set in a range from 0.1 to 10% by weight, preferably from 0.1 to 5% by weight, with respect to the entire constituent monomers in the outermost layer, from the viewpoints of improving the anti-hygroscopic property and chargeability.

In contrast, with respect to the other layers, for example, the intermediate layer and the center portion in the case of the three-layer structure of the resin particle, it is preferable to avoid the structure in which these layers contain the acidic monomer, from the viewpoint of further improving the anti-hygroscopic property and chargeability.

In any of the structures of the resin particles, the content of the acidic monomer in the resin particles is normally from 0 to 1.5% by weight, preferably from 0 to 0.5% by weight, with respect to the entire constituent monomers.

In the case when the resin particle has the three-layered structure, the weight-average molecular weight of each of the layers is not particularly limited, as long as the weight-average molecular weight of the entire resin particles is maintained within the above-mentioned range, and is normally set to each of the following weight-average molecular weights:

Weight-average molecular weight of center portion: 160,000 to 500,000;

Weight-average molecular weight of intermediate layer: 20,001 to 159,999;

Weight-average molecular weight of outer layer: 15,000 to 20,000

The resin particles may be manufactured by using a wet method such as a so-called emulsion polymerization method or a suspension polymerization method, preferably the emulsion polymerization method. More specifically, in the case when the emulsion polymerization method is used, a polymerization composition containing a predetermined monomer is successively added to and dispersed in an aqueous medium containing a polymerization initiator, and the mixture is heated to allow a polymerizing process to progress. A plurality of monomers may be added respectively in a separated manner, or a plurality of monomers, preliminarily mixed with one another, may be added thereto. The monomers may be added as they are, or may be preliminarily mixed with water, a surfactant and the like, and the resulting emulsion solution may be added. The polymerization temperature and the polymerization time may be appropriately set in a range that allows a polymerizing reaction to take place. The particle size of the resin particles is preferably set in a range from 50 to 500 nm in the weight-average particle size.

In the case when composite resin particles having a multi-layered structure are obtained as the resin particles, a multi-stage polymerization method using an emulsion polymerization process and the like is preferably adopted. In other words, a method is preferably used in which: upon manufacturing the composite resin particles, a resin particle (center portion) is formed by using a conventional method such as an emulsion polymerization method, and to the dispersion solution of the resin particles, a polymerization composition containing a predetermined monomer is further added so that a polymerizing process is carried out to form a multi-layered structure (composite structure). In the case when a multi-layered structure containing three or more layers is formed, the above-mentioned further adding/polymerizing processes are repeated, and an aqueous medium is further added thereto, if necessary. In particular, in the case when the composite resin particles have the three-layered structure, from the viewpoints of prevention of wax separation and of improving the chargeability, wax is dissolved or dispersed in the intermediate-layer-forming polymerization composition so that the intermediate layer preferably contains the wax.

In addition to the above-mentioned monomers, known chain transfer agents are normally contained in the polymerization composition on demand, so as to adjust the molecular weight of the polymer. Specific examples of the chain transfer agent include: n-octyl mercaptan, n-dodecyl mercaptan, t-dodecyl mercaptan, 2-mercaptoethanol, diisopropyl xanthogen, carbon tetrachloride, trichlorobromomethane, octan thiol, stearyl thiol, n-octyl 3-mercaptopropionate, α-methyl styrene dimer and ethylene glycol bis(3-mercaptopropionate). These chain transfer agents can be used solely, or two or more of them can be used in combination.

The polymerization initiator to be used in the emulsion polymerization method is not particularly limited as long as it is water-soluble, and examples thereof include: persulfates such as potassium persulfate, sodium persulfate and ammonium persulfate, and a redox initiator formed by combining one of these persulfates used as one component with a reducing agent such as acidic sodium sulfite; and water-soluble polymerization initiators, such as hydrogen peroxide, 4,4'-azobis-cyanovalerate, t-butyl hydroperoxide and cumene hydroperoxide; and a redox initiator formed by combining one of these water-soluble polymerization initiators used as one component with a reducing agent such as ferrous salt; benzoyl peroxide and 2,2'-azobis-isobutylonitrile. These polymerization initiators may be added to the polymerizing system at any of the timings, that is, before the addition of the monomer, simultaneously with the addition thereof and after the addition thereof, and these addition methods may be combined, if necessary.

The aqueous medium normally contains a surfactant. With respect to the surfactant, at least one kind selected from a cationic surfactant, an anionic surfactant and a nonionic surfactant is used. Two or more kinds of these surfactants may be used in combination. Among these, in particular, an anionic surfactant is mainly used preferably.

Specific examples of the cationic surfactant include: dodecylammonium chloride, dodecylammonium bromide, dodecyltrimethylammonium bromide, dodecylpyridinium chloride, dodecylpyridinium bromide, hexadecyltrimethylammonium bromide, and the like.

With respect to the anionic surfactant, preferable specific examples thereof include ionic surfactants, such as sulfonates (sodium dodecylbenzene sulfonate, sodium arylalkylpolyether sulfonate.), sulfates (sodium dodecyl sulfate, sodium tetradecyl sulfate, sodium pentadecyl sulfate, sodium octyl sulfate, etc.) and fatty acid salts (sodium oleate, sodium laurate, sodium caprinate, sodium caprylate, sodium caproate, potassium stearate, calcium oleate, etc.). Nonionic surfactants, such as polyethylene oxide, polypropylene oxide, a combination of polypropylene oxide and polyethylene oxide, esters between polyethylene glycol and higher fatty acid, alkylphenol polyethylene oxide, esters between higher fatty acid and polyethylene glycol, esters between higher fatty acid and polypropylene oxide and sorbitan esters, may be used.

Each of these surfactants is used as an emulsifier at the time of emulsion polymerization, or may be used in another process or for another purpose.

With respect to the wax, various known waxes are proposed. Specific examples of the wax include: olefin-based waxes such as low-molecular-weight polyethylene, low-molecular-weight polypropylene, copolymer polyethylene, grafted polyethylene and grafted polypropylene; ester-based waxes having a long-chain aliphatic group such as behenyl behenate, montanate and stearyl stearate; plant-based waxes such as hydrogenated castor oil and carnauba wax; ketones having a long-chain alkyl group such as distearyl ketone; silicone-based waxes having an alkyl group or a phenyl group; higher fatty acid such as stearic acid; higher fatty acid amides such as oleic acid amide and stearic acid amide; long-chain fatty acid alcohols; long-chain fatty acid polyhydroxy alcohols such as pentaerythritol and partial esters thereof; paraffin-based waxes; and Fischer-Tropsch wax.

With respect to preferable waxes to be added to the toner of the present invention, those composed of a crystalline ester compound represented by the following formula (1) (hereinafter, referred to as "specific ester compound") can be proposed.

$$R^1—(OCO—R^2)n \qquad \text{General Formula (1):}$$

in which each of $R^1$ and $R^2$ independently represents a hydrocarbon group having 1 to 40 carbon atoms, which may have a substituent, and n is an integer of 1 to 4.

In the general formula (1) representing the specific ester compound, each of $R^1$ and $R^2$ represents a hydrocarbon group that may have a substituent. The hydrocarbon group $R^1$ has 1 to 40 carbon atoms, preferably 1 to 20, more preferably 2 to 5. The hydrocarbon group $R^2$ has 1 to 40 carbon atoms, preferably 16 to 30, more preferably 18 to 26. In formula (1), n is an integer of 1 to 4, preferably 2 to 4, more preferably 3 and 4, most preferably 4. The specific ester compound is preferably synthesized through a dehydration condensing reaction between alcohol and carboxylic acid.

With respect to specific examples of the specific ester compound, the following compounds represented by the respective formulas (1w) to (22w) are proposed:

(1w)
$$CH_3—(CH_2)_{12}—COO—(CH_2)_{17}—CH_3$$

(2w)
$$CH_3—(CH_2)_{18}—COO—(CH_2)_{17}—CH_3$$

(3w)
$$CH_3—(CH_2)_{20}—COO—(CH_2)_{21}—CH_3$$

(4w)
$$CH_3—(CH_2)_{14}—COO—(CH_2)_{19}—CH_3$$

(5w)
$$CH_3—(CH_2)_{20}—COO—(CH_2)_6—O—CO—(CH_2)_{20}—CH_3$$

(6w)
$$CH_3—(CH_2)_{20}—COO—(CH_2)_2—\overset{\overset{CH_3}{|}}{CH}—CH_2—O—CO—(CH_2)_{20}—CH_3$$

(7w)
$$CH_3—(CH_2)_{22}—COO—(CH_2)_2—\overset{\overset{CH_3}{|}}{CH}—CH_2—O—CO—(CH_2)_{22}—CH_3$$

(8w)
$$CH_3—(CH_2)_{22}—COO—CH_2—\underset{\underset{CH_3}{|}}{\overset{\overset{CH_3}{|}}{C}}—CH_2—O—CO—(CH_2)_{22}—CH_3$$

(9w)
$$CH_3—(CH_2)_{26}—COO—CH_2—\underset{\underset{CH_3}{|}}{\overset{\overset{CH_3}{|}}{C}}—CH_2—O—CO—(CH_2)_{26}—CH_3$$

(10w)
$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

(11w)
$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

(12w)
$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

(13w)
$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

(14w)
$$\begin{array}{l} CH_2—OH \\ | \\ CH—OH \\ | \\ CH_2—O—CO—(CH_2)_{26}—CH_3 \end{array}$$

(15w)
$$\begin{array}{l} CH_2—OH \\ | \\ CH—OH \\ | \\ CH_2—O—CO—(CH_2)_{22}—CH_3 \end{array}$$

(16w)
$$CH_3—(CH_2)_{26}—COO—CH_2—\overset{\overset{CH_3}{|}}{\underset{\underset{CH_2—O—CO—(CH_2)_{26}—CH_3}{|}}{C}}—CH_2—O—CO—(CH_2)_{26}—CH_3$$

-continued (17w)

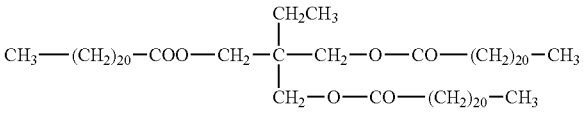

(18w)

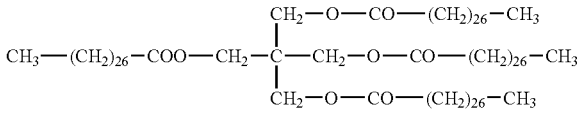

(19w)

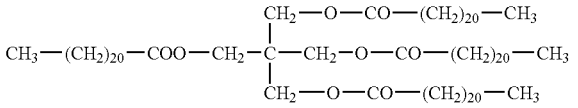

(20w)

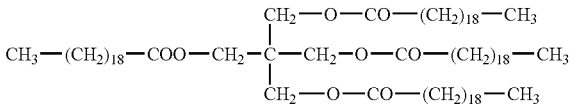

(21w)

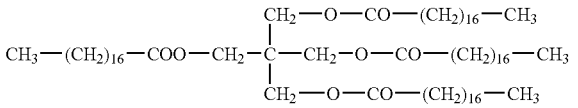

(22w)

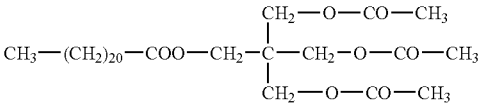

Among these waxes, those which are preferably used for improving the low-temperature fixing property are waxes having a melting point lower than 100° C., preferably in a range from 50 to 100° C., more preferably from 55 to 90° C. The melting point exceeding 100° C. fails to provide sufficient effects for reducing the fixing temperature.

The toner particles forming the toner of the present invention are formed by aggregating/fusing at least resin particles and colorant particles to one another in an aqueous medium through a salting-out process. With respect to the resin particles, in addition to the above-mentioned resin particles containing an amino-group-containing monomer as a constituent monomer, amino-group-containing-monomer free resin particles may be used. The amino-group-containing-monomer free resin particles are the same as the above-mentioned resin particles containing an amino-group-containing monomer, except that no amino-group-containing monomer is contained as the constituent monomer. In the case when the amino-group-containing-monomer free resin particles are used, with respect to the entire monomers constituting the entire resin particles to be used, the amount of the amino-group-containing monomer may be set in the above-mentioned range to such a degree that the resulting toner is allowed to have a predetermined amine value. To the aqueous medium, in addition to the resin particles and colorant particles, toner constituent materials such as wax particles and charge-controlling agent particles may be added, and allowed to aggregate/fuse to one another together with the resin particles and the colorant particles.

The salting-out treatment, which is described in various documents and books concerning colloid as well as in Chapter 6 and thereafter of "Chemistry of Polymer Latex" written by Soichi Muroi, in detail, is a method in which electric double layers of dispersed particles in a solvent are compressed so as to allow the particles to aggregate with one another. In the present invention, a flocculant is normally used so as to carry out the "salting-out" process.

With respect to the flocculant, in addition to a surfactant having a reversed polarity to the polarity of a polar functional group of the resin particles as well as to the polarity of a surfactant to be used as a dispersion solution such as colorant particles to be aggregated together with the resin particle dispersion solution and the resin particles, a divalent or more inorganic metal salt is preferably used. In general, the higher the number of valence, the higher the aggregating force becomes; therefore, the flocculant is properly selected by taking the aggregating speed and the stability of the manufacturing process into consideration. Specific examples of the flocculant include: metal salts, such as calcium chloride, calcium nitrate, barium chloride, magnesium chloride, zinc chloride, aluminum chloride and aluminum sulfate; and inorganic metal salt copolymers, such as aluminum polychloride, aluminum polyhydroxide and calcium polysulfide.

In general, upon adding the flocculant, the temperature of the dispersion system is preferably maintained below 40° C. in order to suppress an abrupt aggregation inside the system. When the flocculant is added under a condition exceeding 40° C., an abrupt aggregation tends to occur, making the particle size control difficult, as well as causing a problem of low bulk density of the resulting particles. Thereafter, in general, this is heated to allow the aggregating and fusing processes of the particles to progress simultaneously; thus, fused particles (toner particles) are generated. With respect to the stirring process, conventionally known stirring devices, such as a reaction vessel having paddle blades, anchor blades, triple sweptback blades, max blend blades, double helical blades and the like, may be used, or devices such as a homogenizer, a homomixer and a Henschel mixer may be used. The number of revolutions in the stirring process is preferably set so as to maintain the system in a turbulent flow state.

The particle size growth through the aggregation (salting-out reaction) is comparatively easily controlled by adjusting the pH and the temperature of the dispersion solution. The pH value is not univocally defined since the value varies depending on ZETA potential and equipotential points of the reaction system, as well as on the kinds and amounts of the flocculant to be used, the kinds and amounts of the surfactant and the particle sizes of the target toner; however, for example, in the case when an aluminum-based flocculant is used, the pH value is set in a range of 2 to 6, and in the case of a magnesium-based flocculant, the pH value is set in a range of 7 to 12.

In the same manner as the pH, although not univocally defined, the reaction temperature is preferably set to a condition in which the particle size growth is controlled within a range of 40 to 95° C. At a temperature higher than this range, the shape of the toner particle tends to become virtually a true spherical shape due to the simultaneous progress of the aggregating and fusing processes. The reaction is maintained for at least not less than 10 minutes at a predetermined temperature, preferably for at least not less than 20 minutes, so that toner particles having a predetermined particle size are obtained. The reaction temperature lower than Tg of the resin only allows the particles to aggregate, and fails to allow the fusing process to progress, while the reaction temperature higher than Tg allows the aggregating and fusing processes to progress simultaneously. In the case of a slow fusing process, the fusiing process may be carried out by raising the temperature after the aggregating process.

In the aggregating/fusing processes, the heating process may be carried out to a predetermined temperature at a constant temperature-rise rate, or may be carried out step by step. The number of revolutions of the stirring blades may be appropriately adjusted.

With respect to the aggregating rate and particle-size control, these controlling operations are carried out by controlling the reaction temperature and the number of revolutions in the stirring process, while monitoring the aggregating state of the particles inside the system by using a microscope and a particle-size measuring device, until the particles have reached a predetermined particle size. When the particles have reached the predetermined particle size, an operation for lowering the aggregating force is carry out so as to stop the particle growth in the system or to delay the growth rate thereof.

With respect to the means for lowering the aggregating force, a means for increasing the stability of the particles or a means for lowering the aggregating function of the flocculant may be used. For example, with respect to the means for increasing the stability of the particles, a method for adjusting the pH of the system toward the stable side (for example, when aggregation is made under an acidic system, an adjustment is carried out from the neutral side toward the alkali side, and when aggregation is made under an alkali system, the adjustment is carried out from the neutral side toward the acidic side), and a method for adding the above-mentioned surfactant and the like may be used. With respect to the means for lowering the aggregating function of the flocculant, metal cations having different numbers of valence may be added so that the aggregating force is greatly lowered due to the antagonistic action thereof. After the aggregating force has been lowered, the system is heated to accelerate the fusing process and also to control the shape toward the spherical-shape side.

With respect to the colorants to be allowed to aggregate/fuse to the resin particles, various kinds of inorganic pigments, organic pigments and dyes are listed. With respect to the inorganic pigments, conventionally known pigments may be used. Although any pigment may be used, preferable examples of the inorganic pigments are shown below: With respect to the black pigments, examples thereof include: carbon blacks such as Furnace Black, Channel Black, Acetylene Black, Thermal Black and Lamp Black, as well as magnetic powder such as magnetite and ferrite. These inorganic pigments may be used alone or a plurality of these may be used in combination, on demand.

With respect to the organic pigments, those of conventionally known pigments may be used. Any pigment of those may be used; and specific organic pigments are shown below.

With respect to magenta or red pigments, examples thereof include: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 81:3, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 184, C.I. Pigment Red 185, C.I. Pigment Red 222, C.I. Pigment Red 238, and the like.

With respect to orange or yellow pigments, examples thereof include: C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 97, C.I. Pigment Yellow 138, C.I. Pigment Yellow 180, and the like.

With respect to green or cyan pigments, examples thereof include: C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

With respect to dyes, examples thereof include: C.I. Solvent Reds 1, 49, 52, 58, 63, 111 and 122; C.I. Solvent Yellows 19, 44, 77, 79, 81, 82, 93, 98, 103, 104, 112 and 162; C.I. Solvent Blues 25, 36, 60, 70, 93 and 95, and the like. A mixture of these may be used.

These organic pigments and dyes may be used alone or a plurality of these may be selected and used in combination, on demand.

These colorants are preferably used as a dispersed matter formed by being dispersed in water in the presence of the above-mentioned surfactant. The dispersion particle size of the colorant dispersed matter is preferably set to not more than 1 μm, more preferably in a range of 100 to 500 nm.

From the viewpoints of anti-hygroscopic property and productivity (aggregating property between resin particles and colorant particles) of the toner, an aminosilane coupling agent is preferably added to the colorant dispersed matter. In other words, the addition of the aminosilane coupling agent thereto makes it possible to improve the stability of the colorant particles and the resin particles, and consequently to improve the productivity of the toner. Since the amount of the acidic monomer in the outermost layer of the resin particle is effectively reduced, it becomes possible to improve the anti-hygroscopic property of the toner. By adding an aminosilane coupling agent thereto, that is, preferably by using an aminosilane coupling agent in combination with acidic colorant particles, in particular, with acidic carbon black, it becomes possible to improve the dispersing property of the colorant particles, and consequently to provide a superior image density, even in the case when the adhered amount of toner of a toner image is comparatively small, that is, for example, 4 to 5.5 $g/m^2$ in a single layer, and 12 to 16.5 $g/m^2$ in a three-layered structure.

With respect to the aminosilane coupling agent, examples thereof include: γ-aminopropyltriethoxy silane, N-(β-aminoethyl)-γ-aminopropyltrimethoxy silane, γ-(2-aminoethyl)-γ-aminopropylmethyl dimethoxy silane, γ-anilinopropyltrimethoxy silane, and the like. Although the added amount of the aminosilane coupling agent is not particularly limited, it is normally from 0.1 to 20% by weight, preferably from 0.1 to 10% by weight with respect to the colorant.

In the case when the wax is allowed to aggregate/fuse to the resin particles as wax particles, those waxes, prepared as a dispersed matter formed by being dispersed in water in the presence of the above-mentioned surfactant, are preferably used. In this case, the dispersion particle size of the wax dispersed matter is preferably set to not more than 1 μm, more preferably in a range of 100 to 500 nm.

With respect to the charge-controlling agent, desired known positive charge-controlling agents may be used alone or in combination, and in the present invention, since superior chargeability is obtained without the necessity of using a charge-controlling agent, it is preferable to avoid using the charge-controlling agent, from the viewpoint of adaptability to color toners. With respect to the positive charge-controlling agent of the present invention, quaternary ammonium chlorides are preferably used. The positive charge-controlling agent is used as a dispersed matter by using the above-mentioned surfactant or the like.

The toner particles, obtained as described above, have a volume-average particle size of 3 to 10 μm, preferably 4 to 7 μm, and are effectively used as the next generation high-resolution toner particles.

The resulting toner particles are normally subjected to a washing process, a drying process and an external additive applying process.

The washing process includes a filtering treatment which filters toner particles from a dispersion solution of the resulting toner particles and a washing treatment which removes adhering matters such as surfactants and flocculants from the toner particles (cake-shaped aggregate) that have been filtered and separated. With respect to the washing means for washing the filtered toner particles, conventionally known methods are used; and for example, a method in which the toner particles that have been filtered and separated are formed into a slurry, and stirred with pure water in a container equipped with a stirring device, and a method in which pure water is applied thereon while the toner particles are being filtered under reduced pressure or filtered through a centrifugal separator are used. In this case, prior to washing with pure water, the toner particles may be preliminarily subjected to an acidic or an alkali treatment, in order to elute/remove surfactants and metal salts that remain in the toner particles.

In the drying process, normally, the toner particles are dried until the moisture of the toner particles has been reduced to not more than 1% by weight, preferably to not more than 0.6% by weight.

In the external additive applying process, a single kind or a plurality of kinds of external additive agents are added to, and mixed with the toner particles that have been dried, to obtain a toner. With respect to the external additive agents, various inorganic oxide fine particles, such as silica, alumina, titania, strontium titanate and cerium oxide, fine particles that have been subjected to a hydrophobization treatment, vinyl-based monomers and metal soups, such as zinc stearate and calcium stearate, may be used. In particular, in full-color toners that are subjected to complex processes, it is desirable to add functional particles that can further improve the fluidity, chargeability, transferring property and cleaning property thereto. The added amount of the external additive agents is preferably set in a range from 0.05 to 5 parts by weight with respect to the toner particles.

Since the toner of the present invention has an amine value in the above-mentioned range, it is effectively used as a positively chargeable toner having a positive charge.

The toner of the present invention is used as a magnetic or non-magnetic mono-component developer or a two-component developer. In the case when the toner of the present invention is mixed with carrier particles, and used as a two-component developer, the carrier particles can be made from conventionally known materials such as metals like iron, ferrite and magnetite, and alloys between these metals and metals such as aluminum and lead.

EXAMPLES

The following description will discuss examples of the present invention in more detail; however, the present invention is not intended to be limited thereby. In the following description, the term "parts" refers to "parts by weight".

<Colorant Dispersion Solution>

(Colorant Dispersion Solution K1)

To 1 kg of Mogul-L (made by Cabot Corporation) were added 30 g of surfactant (E27C: made by Kao Corporation) and 20 g of aminosilane coupling agent (N-(β-aminoethyl)-γ-aminopropyltrimethoxy silane, and this was preliminarily mixed by an Ultra Turrax for one hour to prepare a colorant dispersion solution K1 (solid component concentration: 13.5%).

(Colorant Dispersion Solution K2)

To 1 kg of Mogul-L (made by Cabot Corporation) was added 50 g of surfactant (SDS: made by Mitsubishi Gas Chemical Company, Inc.), and this was preliminarily mixed by an Ultra Turrax for one hour to prepare a colorant dispersion solution K2 (solid component concentration: 13.5%).

<Toner Particles>

Example 1

| (1) Formation of core particles (Center portion)<br>(First-stage polymerization)<br>(Dispersion medium 1) | |
|---|---|
| Sodium dodecyl sulfate | 4.05 g |
| Ion exchanged water | 2,500.00 g |

To a separable flask (5,000 ml) equipped with a stirring device, a thermometer, a cooling pipe and a nitrogen introducing device was loaded the above-mentioned dispersion medium 1, and this was heated to 80° C. in the flask, while being stirred at a stirring speed of 230 rpm under a nitrogen gas flow.

| (Monomer solution 1) | |
|---|---|
| Styrene | 569.00 g |
| n-Butyl acrylate | 65.00 g |
| Dimethylaminoethylmethacrylate | 156.00 g |
| n-Octyl mercaptan | 16.51 g |

To this active agent solution was added an initiator solution prepared by dissolving 9.62 g of a polymerization initiator (potassium persulfate) in 200 g of ion exchanged water, and to this was dripped the above-mentioned monomer solution 1 in 90 minutes, and this system was heated at 80° C. for 2 hours while being stirred to carry out a polymerization process (first-stage polymerization); thus, a latex was prepared. This is referred to as "latex (1H)". The weight-average particle size of the latex (1H) was 70 nm.

| (2) Formation of intermediate layer<br>(Second-stage polymerization)<br>(Monomer solution 2) | |
|---|---|
| Styrene | 123.80 g |
| n-Butyl acrylate | 16.50 g |
| Dimethylaminoethyl methacrylate | 35.31 g |
| n-Octyl mercaptan | 0.72 g |
| WEP-5 (made by NOF Corporation) | 93.80 g |

The above-mentioned monomer solution 2 was loaded into a flask equipped with a stirring device, and heated to 80° C. and dissolved so that a monomer solution was prepared.

| (Dispersion medium 2) | |
|---|---|
| $C_{10}H_{21}(OCH_2CH_2)_2OSO_3Na$ | 0.60 g |
| Ion exchanged water | 2,700.00 g |

The above-mentioned dispersion medium 2 was heated to 98° C., and after 32 g of the above-mentioned latex (1H) as expressed in terms of solid component equivalent that served as the dispersion medium of nucleus particles had been added to this dispersion medium, the monomer solution 2 was mixed and dispersed therein for 8 hours by using a mechanical dispersing machine "CLEARMIX" having a circulation path (made by M Technique Co., Ltd.) to prepare a dispersion solution (emulsion solution) containing emulsified particles (oil droplets).

To this dispersion solution (emulsion solution) was added an initiator solution prepared by dissolving 6.12 g of a polymerization initiator (potassium persulfate) in 250 ml of ion exchanged water, and this system was heated while being stirred at 82° C. for 12 hours to carry out a polymerization process (second stage polymerization) to prepare a latex (dispersion solution of resin particles, each having a structure in which the surface of a latex (latex (1H)) particle covered with a coat film). This is referred to as "latex (1HM)". The weight-average particle size of this latex was 120 nm.

(3) Formation of Outer Layer (Third-Stage Polymerization)

To the latex (1HM) obtained as described above was added an initiator solution prepared by dissolving 8.8 g of a polymerization initiator (KPS) in 350 ml of ion exchanged water, and to this was dripped a mixed solution prepared by adding 350 g of styrene, 95 g of n-butyl acrylate and 5 g of methacrylic acid and further adding 1.0 mole % of n-octyl mercaptan with respect to the above-mentioned monomer to this active agent solution while being uniformly stirred, under a temperature condition of 82° C. in one hour. After the dripping process, this was heated and stirred for 2 hours to carry out a polymerization process (third-stage polymerization), and then cooled to 28° C. to prepare a latex (dispersion solution of composite resin particles, each of which has a center portion made from the latex (1H), an intermediate layer made from the second-stage polymerization resin and an outer layer made from the third-stage polymerization resin, with WEP-5 being contained in the second-stage polymerization resin). This is referred to as "latex (1HML)". The weight-average particle size of this latex was 150 nm.

(4) Preparation of Toner Particles

To a reaction container (four-neck flask) equipped with a temperature sensor, a cooling tube, a nitrogen gas directing device and a stirring device were charged and stirred 250.0 g of the latex (1 HML) (as expressed in terms of solid component equivalent), 900 g of ion exchange water and 150 g of the colorant dispersion solution K1. After the temperature inside the container had been adjusted to 30° C., a 5N sodium hydroxide aqueous solution was added to this solution to adjust the pH to 10.0.

A solution, prepared by dissolving 65.0 g of magnesium chloride hydrate in 1,000 ml of ion exchange water, was dripped therein at 30° C. in 10 minutes, while being stirred. After having been left for 3 minutes, this was heated to 92° C. to form associated particles. In this state, the particle size of the associated particles was measured by "Coulter Counter TA-II", and at the time when the number-average particle size was set to 6.1 μm, an aqueous solution, prepared by dissolving 80.4 g of sodium chloride in 1,000 ml of ion exchanged water, was added thereto to stop the growth of the particles, and this was further heated and stirred at a solution temperature of 94° C. as a maturing process so that the fusion of the particles and the phase separation of the crystalline substance were continued (maturing process). In this state, the shape of the associated particles was measured by a "FPIA-2000", and at the time when the shape coefficient had reached 0.960, this was cooled to 30° C. to stop the stirring process. The associated particles thus formed were filtered, and washed with ion exchanged water at 45° C. repeatedly, and then dried by hot air at 40° C. so that toner particles were obtained.

Examples 2 to 8 and Comparative Examples 1 and 2

The same processes as example 1 were carried out except that in the center portion forming process, the intermediate layer forming process and the outer layer forming process, the amino-group-containing monomer and acid monomer were used so that the rate of use with respect to the entire amount of monomers in each of the processes corresponded to each of amounts shown in Table 1, and that each of the materials shown in Table 1 was used as the colorant dispersion solution; thus, toner particles were obtained. In comparative example 2, at the initial stage of the temperature-raising process, the particle size distribution had two peaks; however, a particle-size controlling process was carried out for a long time to return these peaks to a single peak so that toner particles were formed.

TABLE 1

| | Amino-group-containing monomer content | | | Acid monomer content | | | Amine property | | | Colorant dispersion |
|---|---|---|---|---|---|---|---|---|---|---|
| | center portion | intermediate layer | outer layer | center portion | intermediate layer | outer layer | amine value | total amount of nitrogen | Acid value | (Aminosilane coupling agent) |
| Example 1 | 20.0% | 20.0% | — | — | — | 1.1% | 15.0 | 1.5 | 1.5 | K1 (contained) |
| Example 2 | 30.0% | 30.0% | — | — | — | 1.1% | 25.0 | 2.2 | 1.5 | K1 (contained) |
| Example 3 | 12.0% | 12.0% | — | — | — | 1.1% | 8.5 | 0.8 | 1.5 | K1 (contained) |
| Example 4 | 20.0% | 20.0% | — | — | — | — | 15.0 | 1.5 | 0 | K1 (contained) |
| Example 5 | 4.0% | 36.0% | — | — | — | 1.1% | 14.5 | 1.4 | 1.5 | K1 (contained) |
| Example 6 | 36.0% | 4.0% | — | — | — | 1.1% | 14.7 | 1.45 | 1.5 | K1 (contained) |
| Example 7 | 20.0% | 20.0% | — | — | — | 1.1% | 15.0 | 1.5 | 1.5 | K2 (none) |
| Example 8 | 36.0% | 4.0% | — | — | — | — | 14.7 | 1.45 | 0 | K2 (none) |

TABLE 1-continued

| | Amino-group-containing monomer content | | | Acid monomer content | | | Amine property | | | Colorant dispersion |
|---|---|---|---|---|---|---|---|---|---|---|
| | center portion | intermediate layer | outer layer | center portion | intermediate layer | outer layer | amine value | total amount of nitrogen | Acid value | (Aminosilane coupling agent) |
| Comparative example 1 | 1.25% | 1.75% | — | — | — | 1.1% | 2.5 | 0.20 | 1.5 | K2 (none) |
| Comparative example 2 | 40.0% | 40.0% | 40.0% | — | — | 1.1% | 41 | 4.0 | 1.5 | K2 (none) |

The symbol "—" means no use.

<Production Examples of Toners>

To the toner particles, hydrophobic silica (RA200HS: made by Nippon Aerosil Co., Ltd.) was added at a rate so as to reach 1% by weight and hydrophobic titanium oxide (number-average primary particles size=20 nm, degree of hydrophobization=63) was also added thereto at a rate so as to reach 1% by weight, and this was mixed by a Henschel mixer to produce a toner. The shape and the particle size of the toner were not changed by the addition of the hydrophobic silica and hydrophobic titanium oxide.

<Toner Evaluation>

(Aggregating property)

After the addition of a flocculant, waveforms of the grain distribution were measured at respective temperatures of 60° C., 70° C., 80° C. and 90° C. in the course of a temperature rise up to 92° C., and based upon these waveforms, the stability of the aggregated particles was evaluated.

○: Even after a temperature rise, a single sharp distribution was maintained.

Δ: Even after a temperature rise, a single distribution was maintained although the distribution became slightly broader.

x: In the initial stage of a temperature rise, the latex particles and the colorant particles were completely separated, forming two peaks.

(Heat Resistant Storing Property)

Toner (20 g) was put into a glass bottle, and after having been left at a high temperature of 50° C. for 24 hours, the toner was visually observed.

○: There were no aggregated toner particles, causing no problem.

Δ: Soft aggregation was slightly observed, but easily crumbled with a slight force, causing no problems in practical use.

x: Firmly aggregated clumps were observed, and hardly crumbled to cause serious problems in practical use.

(Fixing Properties)

A color laser printer magicolor2300DL (made by Minolta-QMS Co., Ltd.) was modified in its developing device so as to desirably carry out its temperature control, and also modified so that the photosensitive member was changed to an amorphous silicon photosensitive member, with the potential polarity being switched so as to be used for positively chargeable toner; and this was used for the evaluation. The same toners were loaded into four developing devices. The fixing device had an oil-less fixing mechanism.

Offset

While the temperature of the fixing roller was changed, a solid image having superposed three layers with a total amount of adhesion of 15 g/m$^2$ was outputted with respect to the low-temperature side, and a mono-color gradation image with an amount of adhesion of 0 to 5.0 g/m$^2$ was outputted with respect to the high-temperature side; thus, each image on paper after passing through the fixing roller was observed. In each of the images, evaluation was made based upon a fixing temperature width (non-offset temperature width) in which neither low-temperature offset nor high-temperature offset occurred. With respect to the paper, CF paper (basis weight 80 g/m$^2$), which is standard paper for use in CF900, was used. Images having even a slight offset were evaluated as "no good".

○: The non-offset temperature width was wider than 40° C.

Δ: The non-offset temperature width was from not less than 30° C. to not more than 40° C.

x: The non-offset temperature width is less than 30° C.

Fixing Separation

In the above-mentioned offset evaluation, the roller temperature was set to +15° C. from the lower limit value of the temperature width causing no offset, and a solid image having three superposed layers with a total amount of adhesion of 15 g/m$^2$ was outputted on MT paper (basis weight 64 g/m$^2$). The above-mentioned paper had image losses on the upper and lower ends and the right and left ends, each having a length of 5 mm. Toners that allowed the paper to pass without causing any wrapping onto the fixing roller were evaluated as "○"; toners that had partially irregularities on an image, although the paper was allowed to pass, were evaluated as "Δ"; and toners that failed to allow the paper to pass due to wrapping onto the fixing roller were evaluated as "x".

Low-Temperature Fixing Property

A copied image, fixed onto copy paper at 120° C. in the above-mentioned evaluation methods for the separating property, was folded from the middle portion into two, and the peeling property thereof was visually observed.

○: No problems were caused in practical use without separation.

Δ: Although slight separation occurred, no problems were caused in practical use.

x: Problems were caused in practical use.

(Chargeability)

A color laser printer magicolor2300DL (made by Minolta-QMS Co., Ltd.) was modified so that the photosensitive member was changed to an amorphous silicon photosensitive member, with the potential polarity being switched so as to be used for positively chargeable toner; and images obtained by this apparatus at the initial stage under L/L environments (low-temperature/low-moisture environments: 10° C., 15%), as well as images obtained at the initial stage and after continuous copying operations of 2,000 sheets (after endurance operations) under N/N environments (20° C., 50%), were visually observed. The continuous copying operations were carried out by using a predetermined print pattern with a B/W ratio of 6%.

○: No fogging occurred in any of environments and endurance copied sheets, causing no problems in practical use.

Δ: Although fogging slightly occurred in some of environments or endurance-copied sheets; however, no adverse effects were seen on images.

x: Fogging occurred clearly in some of environments or endurance-copied sheets, and adverse effects were seen on images.

(Anti-Hygroscopic Property)

After having been preliminarily dried in a vacuum drier for 24 hours, the toner was moistened for 24 hours under high-temperature/high-humidity environments (30° C., 80%) for 24 hours, and then measured in its moisture content W by using a Karl Fischer moisture meter. The character "W" represents a moisture content (mg) per 1 kg of toner that has been dried.

○: W≦0.5

Δ: 0.5<W≦1.0 x: 1.0<W (Image Density)

Solid images were outputted, and observed for density irregularities as a whole.

○: Solid images having constant image density were obtained.

Δ: Although there were irregularities in image density on the leading end and rear end on solid images, the irregularities were within a permissible range.

Δ: There was a great difference in image densities between the leading end and rear end on solid images.

TABLE 2

| | Evaluation | | | | | | | |
|---|---|---|---|---|---|---|---|---|
| | | Fixing property | | | | | | |
| | Aggregating property | Fixing separation | Low temperature fixing | Offset | Chargeability | Heat resistant | Anti-hygroscopic property | Density |
| Example 1 | ○ | ○ | ○ | ○ | ○ | ○ | ○ | ○ |
| Example 2 | Δ | ○ | ○ | ○ | ○ | Δ | Δ | ○ |
| Example 3 | ○ | ○ | Δ | ○ | Δ | ○ | ○ | ○ |
| Example 4 | Δ | ○ | Δ | ○ | ○ | ○ | ○ | ○ |
| Example 5 | Δ | ○ | ○ | ○ | Δ | Δ | Δ | ○ |
| Example 6 | Δ | ○ | Δ | ○ | Δ | ○ | Δ | ○ |
| Example 7 | Δ | ○ | Δ | ○ | Δ | ○ | ○ | Δ |
| Example 8 | Δ | ○ | Δ | Δ | Δ | Δ | Δ | Δ |
| Comparative example 1 | Δ | Δ | X | Δ | X | Δ | Δ | Δ |
| Comparative example 2 | X | X | X | X | X | X | X | X |

<Measuring Method>

(Acid Value)

A sample (10 mg) was dissolved in 50 ml of toluene, and colorants were removed therefrom through a membrane filter of 0.1 μm. This was titrated by a solution of N/10 potassium hydroxide/alcohol that had been preliminarily set, using a mixed indicator of 0.1% of bromo-thymol blue and phenol red; thus, the value was obtained from the amount of consumption of the solution of N/10 potassium hydride/alcohol.

(Molecular Weight of Resin)

The molecular weight of the resin, which is found as a weight molecular-weight distribution by using the gel permeation chromatography method (GPC), corresponds to a reduced molecular weight that is obtained based upon a calibration line formed on a basis of monodisperse standard polystyrene. With respect to the measuring conditions, a JASCO TWINCLE HPLC was used as a GPC apparatus, a SHODEX RI SE-31 was used as a detection device, SHODEX GPCA-80M×2 and KF-802 were used as columns and tetrahydrofran was used as a solvent with a flow rate of 1.2 ml/minute; thus, values obtained under these conditions are shown.

(Softening Point(Tm))

A sample to be measured (1.0 g) was weighed, and a flow tester (CFT-500: made by Shimadzu Corporation) was used in which: measurements were made under conditions of the application of a die having a size of h 1.0 mm ×ϕ1.0 mm, a temperature-rise rate of 3.0° C./min, a pre-heating time of 180 seconds, a load of 30 kg and a measuring temperature range of 60 to 150° C., and the temperature at the time of the ½ flow of the above-mentioned sample was defined as the resin softening point (Tm).

(Particle Sizes of Resin Particles and Latex)

Values obtained by a Microtrack UPA150 (made by Nikkiso Co., Ltd.) were used.

(Particle Size of Toner Particles)

Values obtained by a Multisizer II (made by Beckman Coulter, Inc.) were used.

What is claimed is:

1. A positively chargeable toner, comprising:

toner particles that are formed by allowing resin particles containing an amino-group and colorant particles to aggregate, the toner having an amine value in a range of 5 to 35 KOHmg/g and having an acid value in a range of 0.1 to 30 KOHmg/g.

2. The positively chargeable toner according to claim 1, wherein the resin particles are prepared by polymerizing a polymerizable monomer containing an amino-group containing monomer.

3. The positively chargeable toner according to claim 1, having an amine value in a range of 6 to 28 KOHmg/g.

4. The positively chargeable toner according to claim 1, having an acid value in a range of 0.1 to 20 KOHmg/g.

5. The positively chargeable toner according to claim 4, having an acid value in a range of 0.1 to 10 KOHmg/g.

6. The positively chargeable toner according to claim 1, having a total amount of nitrogen in the toner from 0.5 to 3.0%.

7. The positively chargeable toner according to claim 2, wherein a content of the amino-group containing monomer is from 4 to 30% by weight with respect to the entire monomer components constituting resin particles.

8. The positively chargeable toner according to claim 1, wherein a weight-average molecular weight (Mw) of polymer forming the resin particles is from 15,000 to 500,000.

9. The positively chargeable toner according to claim 1, wherein a softening point of polymer forming the resin particles is from 90 to 140° C.

10. The positively chargeable toner according to claim 1, wherein the toner particles have a volume-average particle size of 4 to 7 μm.

11. The positively chargeable toner according to claim 1, wherein the resin particles contains an acid monomer as a constituent monomer and a content of the acidic monomer is from greater than 0 to 1.5% by weight with respect to the entire constituent monomers.

12. The positively chargeable toner according to claim 11, wherein a content of the acidic monomer is from greater than 0 to 0.5% by weight with respect to the entire constituent monomers.

13. The positively chargeable toner according to claim 4, wherein the resin particles containing an amino-group include a monomer having the amino-group and a monomer having an acidic group as a constituent monomer.

14. The positively chargeable toner of claim 13, wherein the resin particles containing an amino-group comprises a core, an intermediate layer and an outer layer, the intermediate layer and the core include the monomer having an amino-group as a constituent monomer, and the outer layer comprises the monomer having an acidic group.

* * * * *